US005765475A

United States Patent [19]

Salomon

[11] Patent Number: 5,765,475

[45] Date of Patent: Jun. 16, 1998

[54] HYBRID PRINTING POSTAGE PRINTER

[75] Inventor: James A. Salomon, Cheshire, Conn.

[73] Assignee: Pitney Bowes Inc., Stamford, Conn.

[21] Appl. No.: 767,354

[22] Filed: Dec. 18, 1996

[51] Int. Cl.[6] ..... B41L 47/46

[52] U.S. Cl. ..... 101/91; 347/32; 101/92

[58] Field of Search ..... 101/91, 92, 93; 347/2, 4, 29, 32

[56] References Cited

U.S. PATENT DOCUMENTS

| | | | |
|---|---|---|---|
| 3,869,986 | 3/1975 | Hubbard | 101/91 |
| 4,223,322 | 9/1980 | van Raamsdonk | 346/140 R |
| 4,369,456 | 1/1983 | Cruz-Uribe et al. | 346/140 R |
| 4,571,601 | 2/1986 | Teshima | 346/140 R |
| 4,673,303 | 6/1987 | Sansone et al. | 400/126 |
| 4,829,318 | 5/1989 | Racicot et al. | 346/1.1 |
| 4,970,534 | 11/1990 | Terasawa et al. | 347/32 |
| 5,260,724 | 11/1993 | Tomii et al. | 347/32 |

*Primary Examiner*—Christopher A. Bennett
*Attorney, Agent, or Firm*—Angelo N. Chaclas; Melvin J. Scolnick

[57] ABSTRACT

An postage printer including a print drum for printing a postage indicia having a fixed portion and a variable portion, the print drum including a first print surface and a second print surface, the postage printer comprising: an ink jet print head for printing the variable portion of the postage indicia on the second print surface; a print head cap; mechanism for bringing the ink jet print head and the print head cap into a capped relationship and a spaced apart relationship; wherein the ink jet print head prints while the ink jet print head and the print head cap are in the spaced apart relationship and the print drum passes between the print head and the print head cap. A method of printing a postage indicia having a fixed portion and a variable portion, the method comprising the steps of: (a) rotating a print drum through a print cycle; (b) bringing an ink jet print head and a print head cap into a capped relationship and a spaced apart relationship; and (c) while the ink jet print head and the print head cap are in the spaced apart relationship and the print drum passes between the print head and the print head cap, printing the variable portion of the postage indicia on a print surface of the print drum using the ink jet print head.

15 Claims, 8 Drawing Sheets

HYBRID PRINTING POSTAGE PRINTER

CROSS REFERENCE TO RELATED APPLICATIONS

This application is a related to copending U.S. patent application Ser. No. 08/767,355 filed concurrently herewith, and entitled INK JET TRANSFER PRINTER, the disclosure of which is specifically incorporated herein by reference.

FIELD OF THE INVENTION

The present invention relates generally to postage printers. More particularly, the invention relates to a postage printer which employs a die to print the fixed portion of a postage indicia and an ink jet print head to print the variable portion of the postage indicia.

BACKGROUND OF THE INVENTION

Examples of postage printers are postage meters which are well known in the art and commonly include a selectively operable print means for printing postage indicia on envelopes or the like. The postage indicia supplies visual evidence of the fact that postage has been paid and accounted for. In traditional postage meters, two types of printing means are employed: one being a die plate located on the peripheral surface of a print drum that is adapted to print the fixed portion of the postage indicia, such as the graphics design, town and state, while the other print means is adapted to print the variable portion of the postage indicia, such as the date and value of postage dispensed. In such traditional postage meters, this printing means usually includes a plurality of print wheels which project through suitable apertures formed in the curved surface of the die plate. Each print wheel contains a plurality of alpha-numeric characters which are selectively rotatable to project through the die plate. In order to print the postage indicia, the print drum is rotated and the die plate and the print wheels are suitably inked prior to the print drum coming into contact with the envelope. After inking, the print drum continues to rotate and the die plate and the print wheels are brought into contact with the envelope where the ink transfers to the envelope resulting in the postage indicia printed on the envelope.

In order to vary the postage value and the date, the operative positions of the print wheels, which are mounted to bodily rotate with the interior of the print drum, must be changed. Since these print wheels are not directly accessible to the operator, the print wheels are operatively connected to an associated setting mechanism which is also located primarily inside the print drum. The setting mechanism is normally connected to a motor for rotating the print wheels to a desired position in response to inputs from a keyboard. In the alternative, the setting mechanism is connected to levers which extend outside the postage meter housing so that the operator can manipulate the print wheels manually. Both of these arrangements necessitate a rather intricate, complex and costly mechanism to enable the print wheels to be set to a desired position and then rotated along with the print drum through a print cycle.

The postage meters disclosed in U.S. Pat. No. 3,869,986 entitled INK JET PRINTING POSTAGE PRINTING APPARATUS and U.S. Pat. No. 4,673,303 entitled OFFSET INK JET POSTAGE PRINTING, both of which are assigned to the assignee of the present invention, depart from the traditional postage meters described above by incorporating ink jet printing technology. The print wheels and associated setting mechanisms are dispensed with and replaced with an ink jet print head.

Ink jet printers are well known in the art. Generally, an ink jet printer includes an array of nozzles or orifices, a supply of ink and a plurality of ejection elements (typically either expanding vapor bubble elements or piezoelectric transducer elements) corresponding to the array of nozzles for ejecting the ink from the nozzles. The ink ejected in this manner forms drops which travel along a trajectory or flight path until they reach a print medium such as a sheet of paper, overhead transparency, envelope or the like. Once they reach the print medium, the drops dry and collectively form a print image. Typically, the ejection elements are selectively energized so that a predetermined or desired print image is achieved.

In U.S. Pat. No. 3,869,986, the ink jet print head is positioned to print directly on the envelope through suitable apertures in the print drum while the print drum is rotating through a print cycle. The print drum still contains a die plate for printing the fixed portion of the postage indicia while the ink jet print head prints the variable portion.

Although this system removes the complexity of the setting mechanism, it suffers from various drawbacks. For example, the nozzles of the print head must be energized at the precise moment when the aperture appears between the print head and the envelope. Otherwise, the ink will deposit on the inner surface of the print drum instead of the envelope. Thus, the timing of the rotation of the print drum and the energizing of the nozzles must be precisely controlled. As another example, no provisions are made is for the maintenance of the print head. Left unattended, the print head may either drip ink or in the alternative become clogged due to evaporation of ink or an accumulation of paper dust and other contaminants. Clearly, either event is undesirable. Another drawback is that the print head is spaced far away from the envelope due to the thickness of the print drum. Thus, a large print gap is created which reduces print quality.

In U.S. Pat. No. 4,73,303, the ink jet print head is positioned to print on the print drum. The print drum includes a first region containing the die plate of the fixed portion of the postage indicia and a second region which receives ink from the print head. During a print cycle, the second region is depressed below the periphery of the print drum so that the inking rollers for the first region do not spread ink onto the second region. Then, the second region is brought back into alignment with the periphery of the print drum and the print head applies ink thereon to form the variable portion of the postage indicia. As the print drum comes into contact with the envelope, both the ink from the die plate and the second region are transferred to the envelope.

Although this system removes the complexity of the setting mechanism, it suffers from various drawbacks. For example, depressing and raising the second region during a print cycle requires a complex mechanism. Additionally, this system does not provide for maintenance of the print head. Therefore, it suffers from the same drawbacks as previously discussed above.

For all of the above reasons, it becomes apparent that there are difficulties and drawbacks associated with the prior art postage meters. Therefore, there is a need for a postage printer which is mechanically simple and which combines the best aspects of die plate printing and ink jet printing in a practical solution.

SUMMARY OF THE INVENTION

It is an object of the present invention to present a postage printer that substantially overcomes the disadvantages and problems associated with the prior art systems.

In accomplishing this and other objects there is provided a method of printing a postage indicia having a fixed portion and a variable portion, the method comprising the steps of: (a) rotating a print drum through a print cycle; (b) bringing an ink jet print head and a print head cap into a capped relationship and a spaced apart relationship; and (c) while the ink jet print head and the print head cap are in the spaced apart relationship and the print drum passes between the print head and the print head cap, printing the variable portion of the postage indicia on a print surface of the print drum using the ink jet print head.

In accomplishing this and other objects there is provided a postage printer including a print drum for printing a postage indicia having a fixed portion and a variable portion, the print drum including a first print surface and a second print surface, the postage printer comprising: an ink jet print head for printing the variable portion of the postage indicia on the second print surface; a print head cap; mechanism for bringing the ink jet print head and the print head cap into a capped relationship and a spaced apart relationship; wherein the ink jet print head prints while the ink jet print head and the print head cap are in the spaced apart relationship and the print drum passes between the print head and the print head cap.

Additional objects and advantages of the invention will be set forth in the description which follows, and in part will be obvious to those skilled in the art from the description, or may be learned by practice of the invention.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
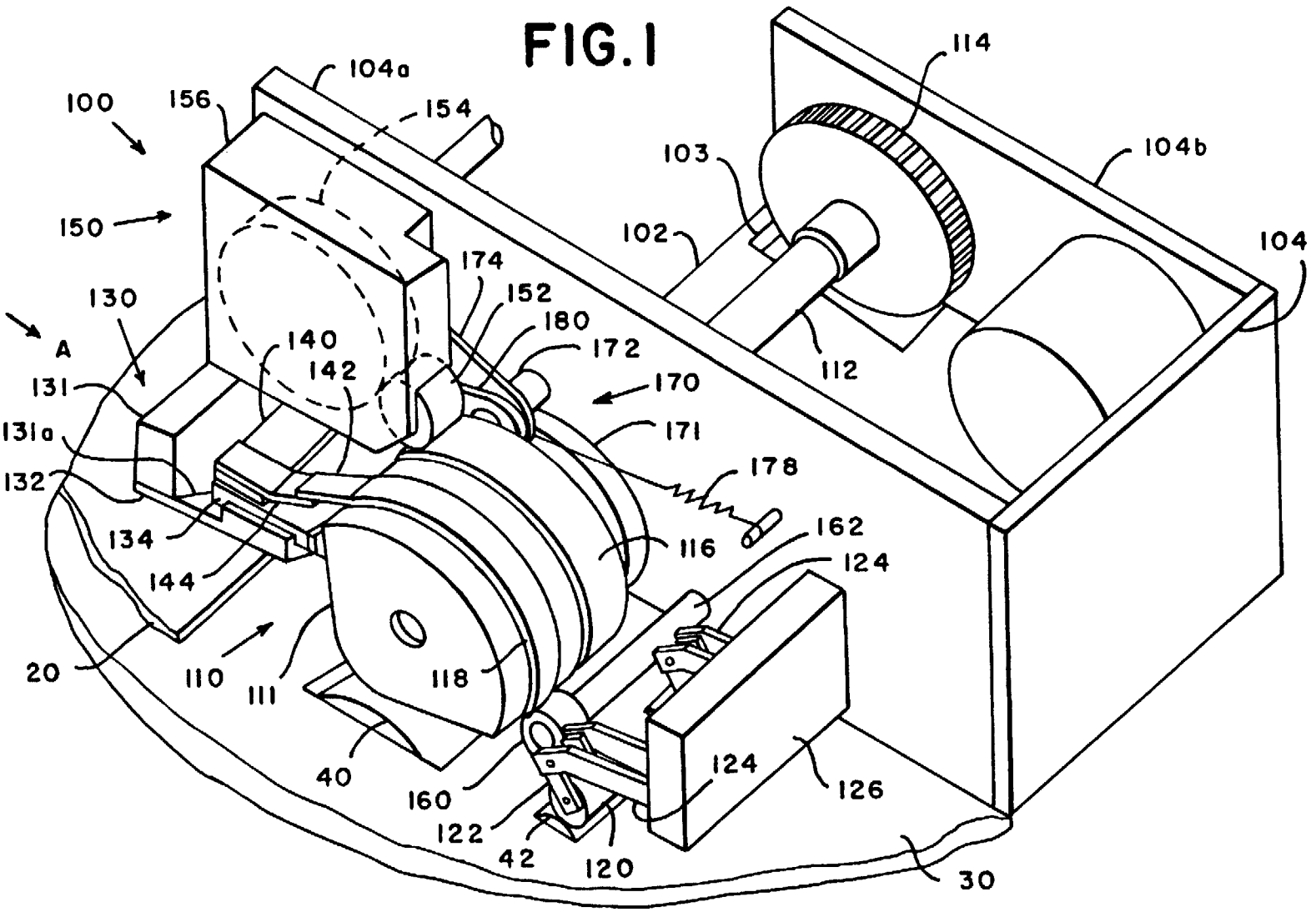
FIG. 1 is a schematic representation of a perspective view of a postage meter in accordance with a first embodiment of the present invention.
Figure 2:
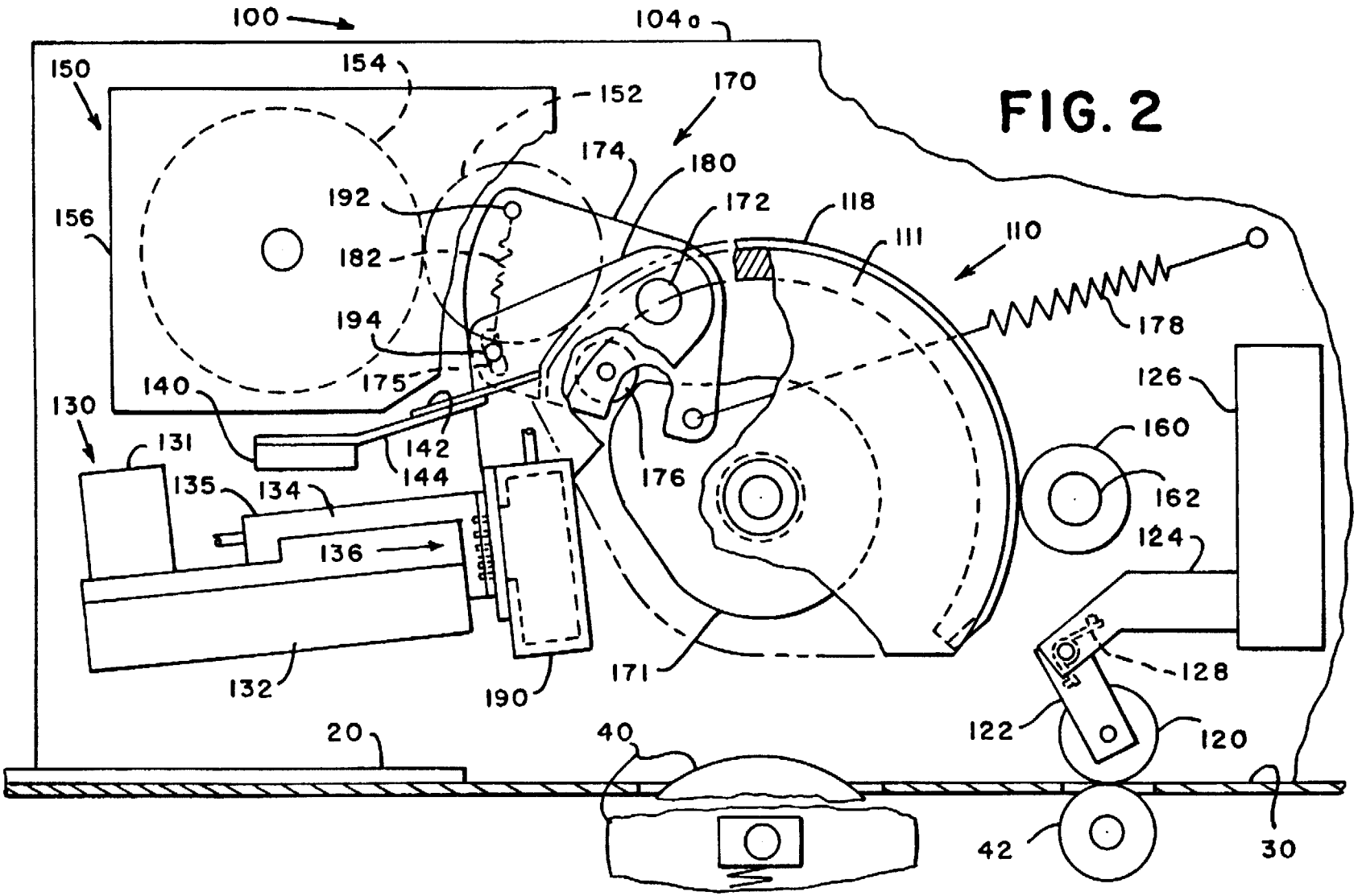
FIG. 2 is a schematic representation of a front elevational view of the postage meter with a print drum in a home position in accordance with the first embodiment of the present invention.

Referring to FIGS. 1 and 2, a first embodiment of a postage meter 100 including a base 102, a frame 104, a print drum assembly 110, a print head module 130, an ink roller assembly 150 and a print head maintenance module 170 incorporating the present invention is shown. Generally, an envelope 20 is fed in a path of travel along a deck 30 of a mailing machine (partially shown) as indicated by arrow A so as to pass underneath the print drum assembly 110 of the postage meter 100 which prints a postage indicia thereon.

Figure 5:
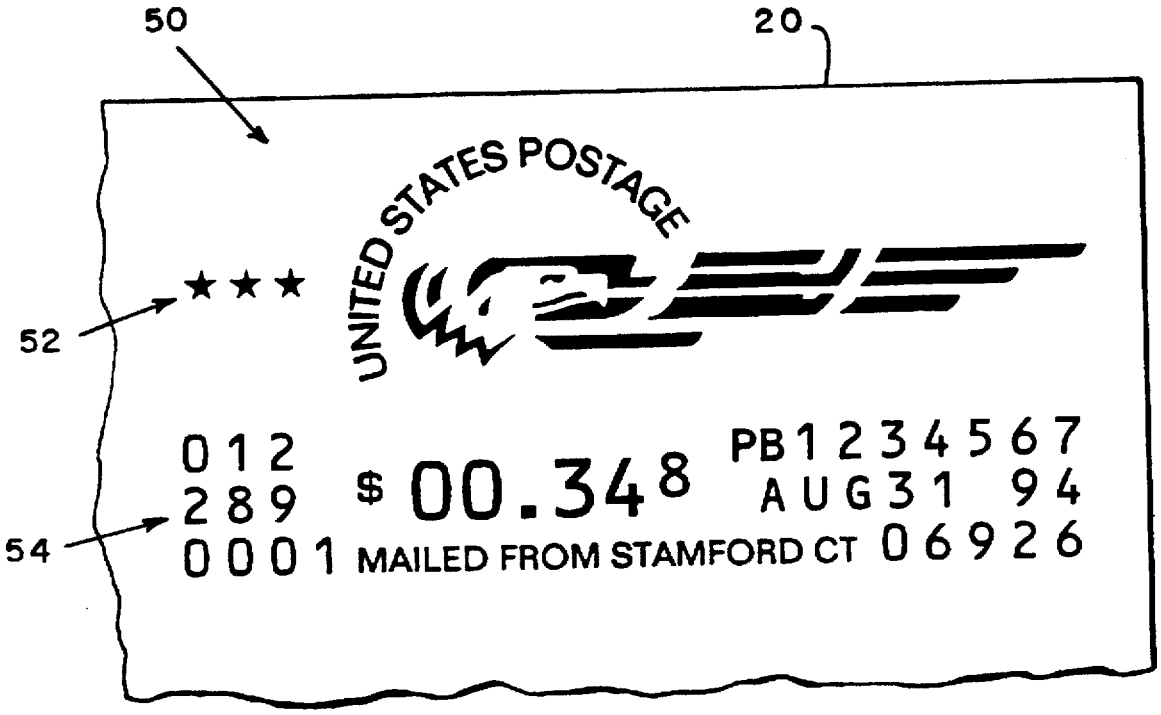
FIG. 5 is an example of a postage indicia suitable for use in the postage meter of the present invention.

Referring to FIG. 5, an example of a postage indicia 50 suitable for use with the present invention is shown. The postage indicia 50 includes a fixed portion 52 containing a graphics design and a variable portion 54 containing the variable information which changes with each envelope or from postage meter to postage meter, such as: date, postage value, town, meter serial number and other information necessary to detect fraudulent use of the postage meter 100. Alternatively, the meter serial number could be located in both the fixed portion 52 as well as the variable portion 54, or just in the fixed portion 52.

Figure 3:
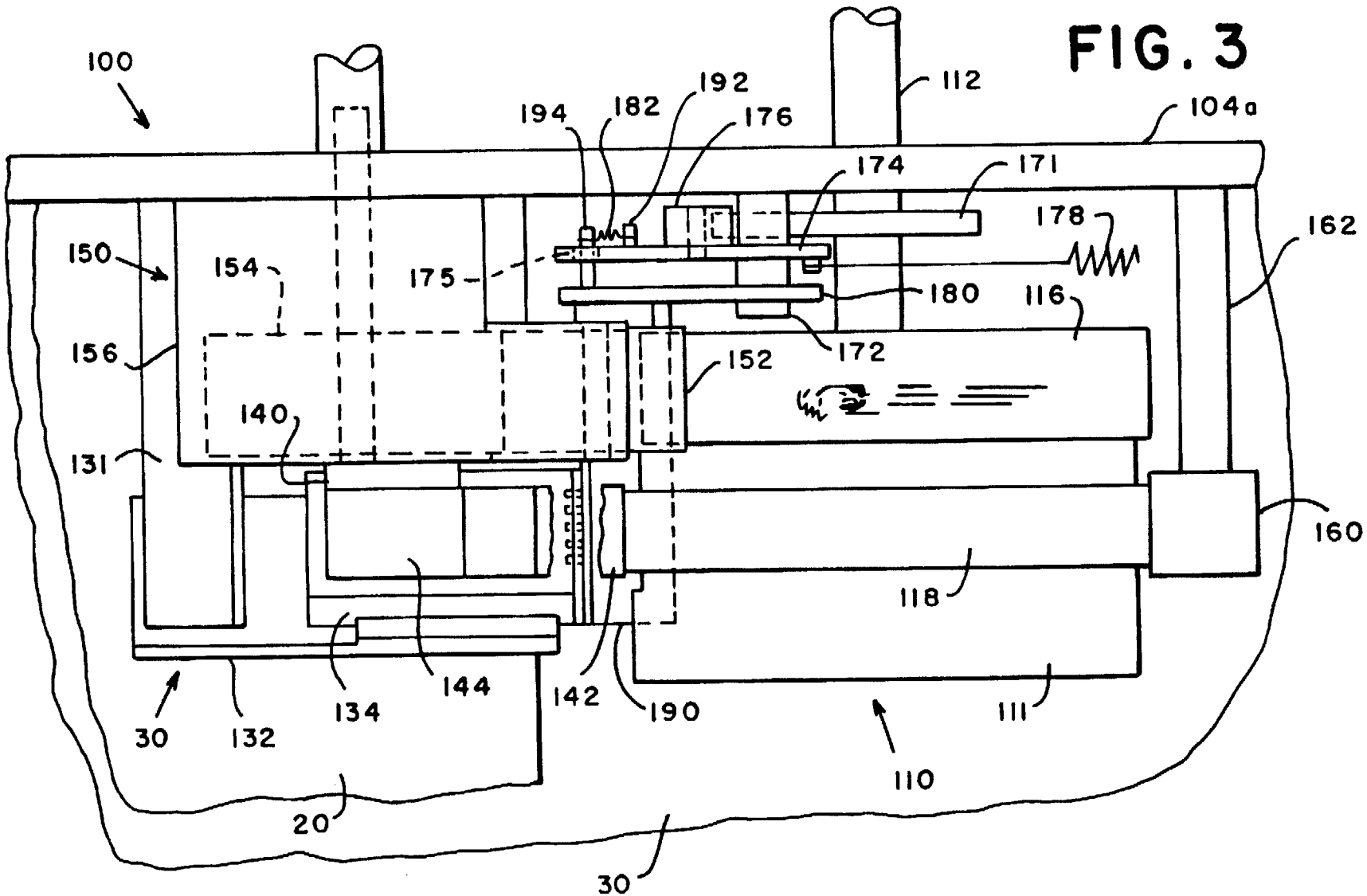
FIG. 3 is a schematic representation of a top view of the postage meter with the print drum in the home position in accordance with the first embodiment of the present invention.

Referring to FIGS. 1, 2 and 3, the print drum assembly 110 includes a print drum 111 fixably mounted to a print drum shaft 112 which is rotatively mounted to extend between walls **104*a* and 104*b* of the frame 104. Also fixably mounted to the print drum shaft 112 is a gear 114 which extends through an aperture 103 in the base 102 so that a drive gear (not shown) protruding from a mailing machine is brought into meshed engagement with the gear 114 when the postage meter 100 is placed on the mailing machine. In this manner, the mailing machine supplies the drive means necessary to cause the print drum 111 to rotate. The print drum 111 includes a first print surface 116 having a die plate (not shown) for printing a fixed portion of the postage indicia and a second print surface 118 for printing a variable portion of the postage indicia. It is important to note that the first print surface 116 and the second print surface second print surface 118 are in substantial alignment which each other so that they both contact the envelope 20** during the print cycle.

The print drum assembly 110 also includes an encoder system (not shown) of any suitable conventional design for tracking the position of the print drum 111. In this manner, the rotation of the print drum 111 can be accurately controlled and coordinated with the operation of a print head 134 to produce a quality print. A more detailed description of the operation of the print drum assembly 110 including the print drum 111 will be set forth below.

The print head module 130 includes a print head frame 131 fixably mounted to wall **104*a*, a print head bracket 132 and the print head 134. The print head frame 131 includes an angled portion 131*a* on which the print head bracket 132 is fixably mounted while the print head 134 is detachably mounted to the print head bracket 132. In the preferred embodiment, the print head 134 includes an ink reservoir 135 for storing a supply of ink and a plurality of nozzles 136 through which the ink is ejected. Thus, the print head 134 is designed to be replaced as needed by the operator loading in a new print head 134. The print head bracket 132 and the print head 134 are designed such that the nozzles 136 are spaced apart from and in opposed relationship to the second print surface 118 of the print drum 111 for printing the variable portion 54 of the postage indicia 50**.

The ink roller assembly 150 is detachably mounted to wall **140*a* by any suitable conventional means. Thus, it too is designed to be replaced as needed by the operator. The ink roller assembly 150 includes a inking roller 152, an ink supply roller 154 and an ink housing 156 which contains a supply of ink. The inking roller 152** and the ink supply roller 154 are both rotatively mounted to the ink housing 156 so as to be in rotational engagement with each other. The ink supply roller 154 remains in contact with the supply of ink and ensures that the inking roller 152 is sufficiently saturated with ink. The inking roller 152 is positioned to also be in rotational engagement with the first print surface 116 of the print drum 111. In this manner, ink is applied to the die plate of the first print surface 116 for printing the fixed portion 52 of the postage indicia 50. It is important to note that the ink contained in the ink roller assembly 150 may be the same as or different from the ink utilized by the print head 134.

The print head maintenance module 170 includes a print head cap 190 which is adapted to fit over the nozzles 136 of the print head 134 and a mechanism for repositioning the print head cap 190 into and out of engagement with the print head 134 in relation to the rotation of the print drum 111. In the preferred embodiment, the print head cap 190 is designed to provide an air tight seal around the print head 134 and is operatively connected to a suitable vacuum source (not shown) for sucking ink from the nozzles 136. Since the operation of print head maintenance modules is well known in the art and since it does not constitute a part of the present invention, no further description is being provided.

The mechanism for repositioning the print head cap 190 includes a cam 171 fixably mounted to the print drum shaft 112 so as to rotate along with the print drum 111 during a print cycle, a follower plate 174, a follower 176 and a cap plate 180. The follower plate 174 and the cap plate 180 are pivotally mounted along side each other to a pivot shaft 172 which is in turn fixably mounted to wall 104*a*. Rotatively mounted to the follower plate 174 is a follower 176 which is biased against the cam 171 by a follower spring 178 extending between the follower plate 174 and wall 104*a*. Thus, the follower 176 remains in rolling contact with the cam 171 and causes the follower plate 174 to pivot about the pivot shaft 172 in accordance with the position of the follower 176 on the cam 171. Fixably mounted to and extending outward from the cap plate 180 is a pin 194 which is in slotted engagement with a slot 175 in the follower plate 174. A plate spring 182 extends between a pin 192 fixably mounted on the follower plate 174 and the pin 194. In this manner, the follower plate 174 and the cap plate 180 are operatively coupled so that the cap plate 180 is biased outward. Thus, since the print head cap 190 is fixably mounted to the cap plate 180, the print head cap 190 is biased toward the print head 134.

In order to produce a quality print, the postage meter 100 includes further devices designed to maintain the print drum 111, and more particularly the second print surface 118. A wiper blade 142 is positioned to engage the second print surface 118 during the print cycle and prior to the print head 134 applying ink to the second print surface 118. In this manner, the second print surface 118 is wiped clean before each print cycle. The wiper blade 142 is mounted to a wiper blade leaf spring 144 which is in turn mounted to a wiper blade bracket 140 fixably attached to wall 104*a*. Thus, the wiper blade 142 is biased toward the print drum 111 to ensure that the wiper blade 142 remains in intimate contact with second print surface 118. Preferably, the wiper blade 142 is made from any suitably durable material which demonstrates appropriate elastomeric properties so as to clean the second print surface 118 without damaging or scratching the second print surface 118, such as urethane. Additionally, the postage meter 100 includes a cleaning roller 160 which is rotatively mounted to a cleaning roller shaft 162 which is in turn fixably mounted to wall 104*a*. The cleaning roller 160 is located to be in contact with the second print surface 118 during the print cycle but only after the print head 134 has applied ink to the second print surface 118 and the ink has been transferred to the envelope 20. Thus, in contrast to the wiper blade 142, the cleaning roller 160 performs a post-printing cleaning operation. Preferably, the cleaning roller 160 is made of a resilient foam material having suitable ink absorption properties. Alternatively, the cleaning roller 160 could be a pad or web of absorbent material.

The postage meter 100 further includes a pair of conventional eject rollers 120 which are mounted to an eject roller frame 126 using eject roller arms 122 and eject roller brackets 124. Extending between the eject roller arms 122 and the eject roller brackets 124 are a pair of eject roller springs 128 which operate to bias the eject rollers 120 toward the eject pressure rollers 42.

With the structural aspects of the postage meter 100 described as above, the operational aspects of the postage meter 100 will now be described. Referring to FIG. 2, the print drum 111 is shown in the home position. In this position, the print head cap 190 is held firmly against the print head 134 so that the nozzles 136 are sealed off from the ambient air. In this position, various maintenance routines involving purges of the nozzles 136 and applying suction to the nozzles 136 can be performed. The print drum 111 remains in the home position until the print cycle is initiated.

Figure 4:
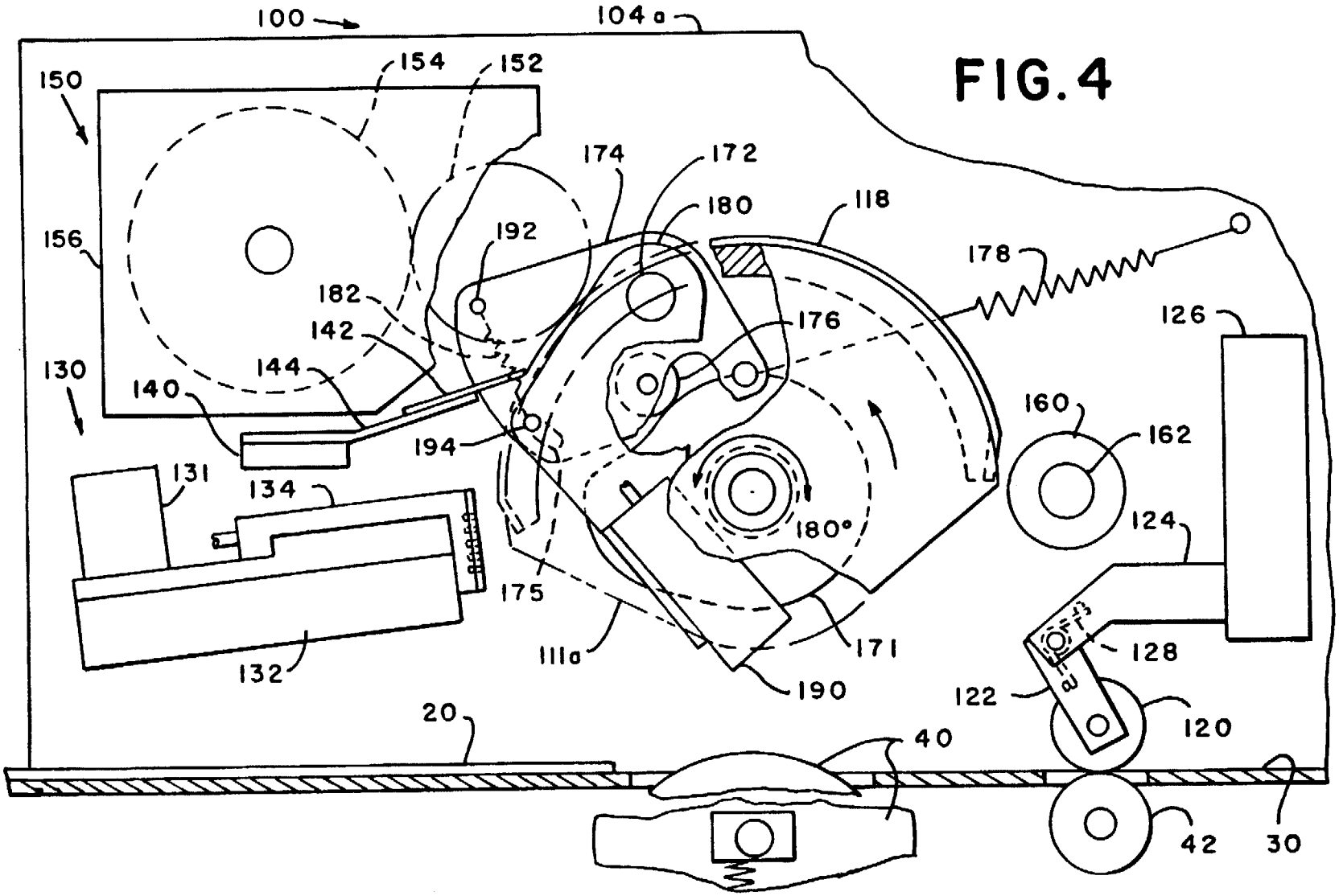
FIG. 4 is a schematic representation of a front elevational view of the postage meter with the print drum in an intermediate position along a print cycle in accordance with the first embodiment of the present invention.

Referring to FIG. 4, the print drum 111 is shown just after the print cycle has been initiated. During the print cycle, the print drum 111 rotates in a counter clockwise direction as indicated by arrow B. Since the cam 171 rotates along with the print drum 111, the follower 176 repositions accordingly causing the follower plate 174 to pivot about the pivot shaft 172. As the follower plate 174 pivots, the cap plate 180 pivots in corresponding fashion and the print head cap 190 moves away from the print head 134 and toward the interior of the print drum 111. To accommodate this movement of the print head cap 190, the print drum 111 has a substantially hollow interior and a sufficiently large aperture 111 a around its periphery. That is, the peripheral surface of the print drum 111 which contains the first print surface 116 and the second print surface 118 only extends approximately 180 degrees. The remainder of the print drum 111 is cut away to allow the print head cap 190 to reposition between a capped position up against the print head 134 while the print drum 111 is in the home position and an uncapped position interior to the print drum 111 while the print drum 111 is moving through the print cycle.

Referring to FIGS. 1, 3 and 4, as the print drum 111 rotates, the inking roller 152 applies ink to the die plate located on the first print surface 116. Additionally, the nozzles 136 of the print head 134 are selectively energized by any suitable controller to eject ink as the second print surface 118 passes by the nozzles 136. As the print drum 111 continues to rotate, it comes into contact with the envelope 20 which has been simultaneously fed along the deck 30 to pass underneath the print drum 111. The feeding of the envelope 20 and the rotation of the print drum 111 are synchronized so that the first print surface 116 and the second print surface 118 come into contact with the envelope 20 near its upper right hand corner. As the first print surface 116 and the second print surface 118 contact the envelope 20, the ink from these respective surfaces transfers to the envelope 20 leaving a printed image of the postage indicia 50 which includes both the fixed portion 52 and the variable portion 54. After printing, the print drum 111 continues to rotate until it again reaches the home position.

Located directly beneath the print drum 111, the mailing machine includes a print pressure roller 40 which is spring biased toward the print drum 111 in conventional fashion so as to accommodate the varying thicknesses of different envelopes 20. As the envelope 20 continues downstream from the print drum 111, it comes under the control of the eject rollers 120. The mailing machine further includes a pair of eject pressure rollers 42 in opposed relationship to the eject rollers 120 for assisting in feeding the envelope 20 from the postage meter 100.

Figure 6:
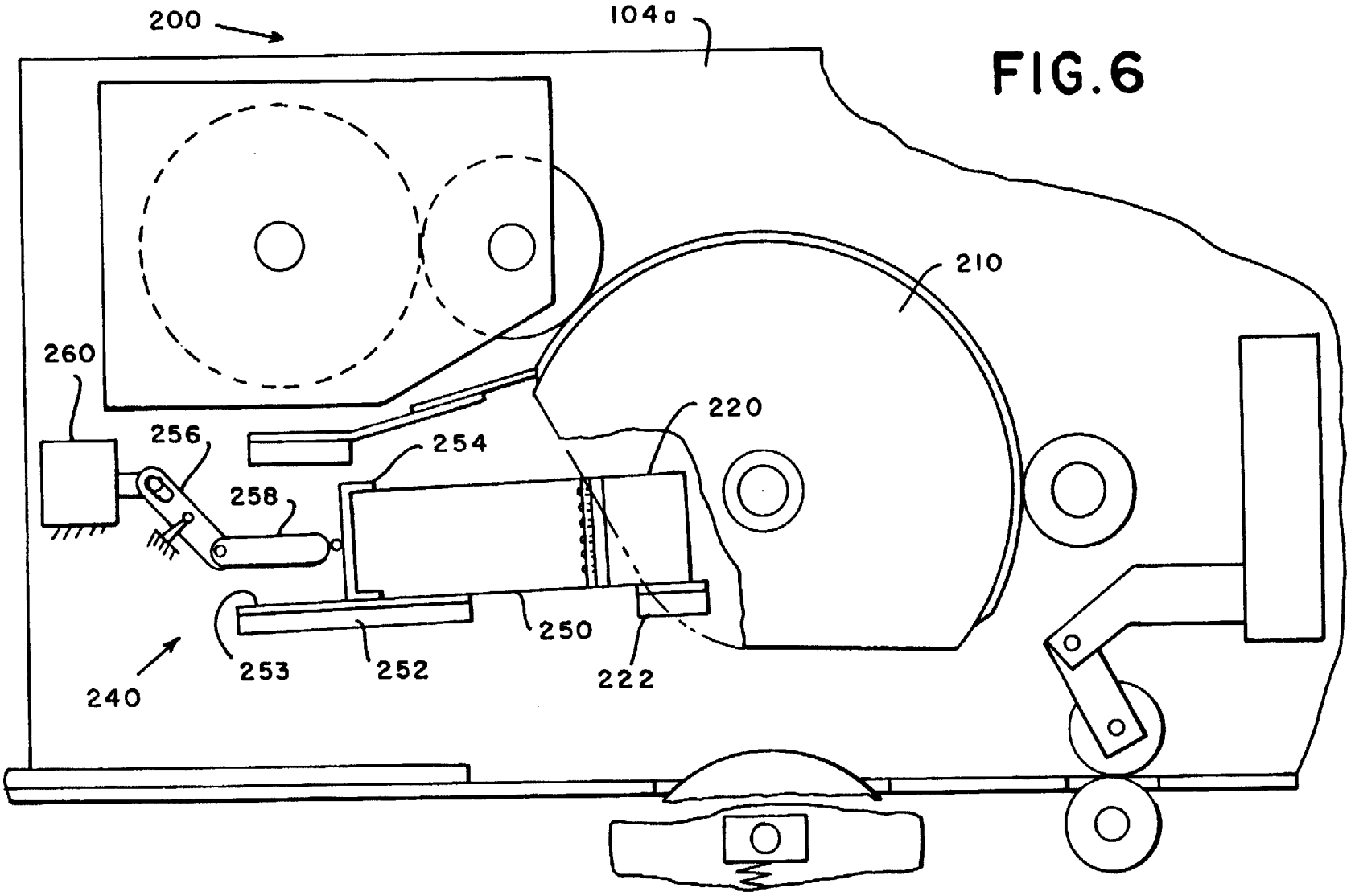
FIG. 6 is a schematic representation of a front elevational view of the postage meter with a print drum in a home position in accordance with a second embodiment of the present invention.

Referring to FIG. 6, a postage meter 200 including a print drum 210 in a home position in accordance with a second embodiment of the present invention is shown. Since the print drum 210 and most other features of the postage meter 200 are substantially equivalent to those of the first embodiment, those features will not be further described. Instead, the description which follows will focus on those features which are different.

Figure 7:
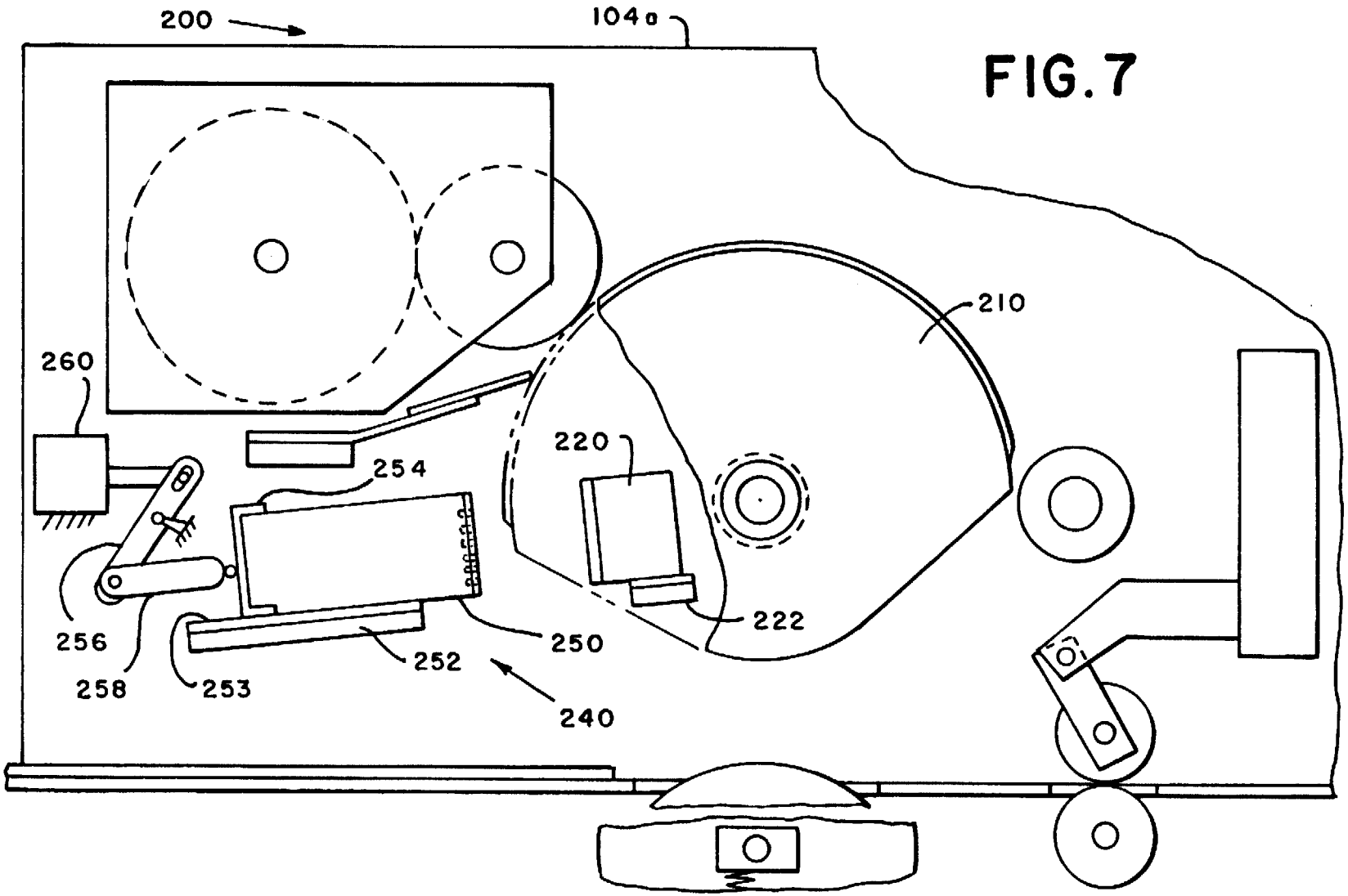
FIG. 7 is a schematic representation of a front elevational view of the postage meter with the print drum in an intermediate position along a print cycle in accordance with the second embodiment of the present invention.

Referring to FIG. 7, the print drum 210 is shown an intermediate position along the print cycle. Referring to FIGS. 6 and 7, the postage meter 200 includes a print head cap 220 which is fixably mounted to the wall 104*a* using any conventional means, such as an L-shaped bracket 222, and a print head assembly 240. The print head assembly 240 includes a solenoid 260 and a print head 250 which is preferably detachably mounted to a carriage 254 which is in turn slideably mounted to a bracket 252 having guide rails 253. The bracket 252 is fixably mounted to wall 104*a*. The print head assembly 240 further includes a linkage mechanism for operatively connecting the solenoid 260 to the print head 250 so as to reposition the print head 250 along the bracket 252. The linkage mechanism includes an arm 256 pivotally connected at a first end to the solenoid 260 and pivotally connected at a second end to a first end of an arm 258. A second end of arm 258 is pivotally connected to the carriage 254. The arm 256 is mounted to a fixed pivot along the length of its span and the solenoid 260 is also fixably mounted to any suitable structure.

Referring to FIG. 6, when the solenoid 260 is in the retracted position, the print head 250 is operatively engaged with the print head cap 220. Preferably, the solenoid 260 remains in the retracted position so long as the print drum 210 is in the home position. Referring to FIG. 7, as the print cycle commences and the print drum 210 leaves the home position, the solenoid 260 moves from the retracted position to an extended position which causes the print head 250 to separate from the print cap 220 and assume a print position. Thus, as the print drum 210 continues to rotate, the periphery of the print drum passes between the print head 250 and the print head cap 220 as in the first embodiment thereby enabling the print head 250 to print on the print drum 210. The operation of the remainder of the postage meter 200 remains substantially similar to that of the first embodiment.

Those skilled in the art will recognize that in the first embodiment the print head 134 is held stationary while the print head cap 190 is actuated into and out of engagement. On the other hand, in the second embodiment the print head cap 220 is held stationary while the print head 254 is actuated into and out of engagement. Thus, relative movement between the print head and the cap can be achieved in a variety of ways.

Those skilled in the art will also recognize that there are many mechanism suitable for providing relative movement between the print head and the cap. For example, the cam 171, the follower plate 174 and the cap plate 180 of the first embodiment can be replaced with a conventional solenoid and linkage assembly as shown in the second embodiment.

Figure 8:
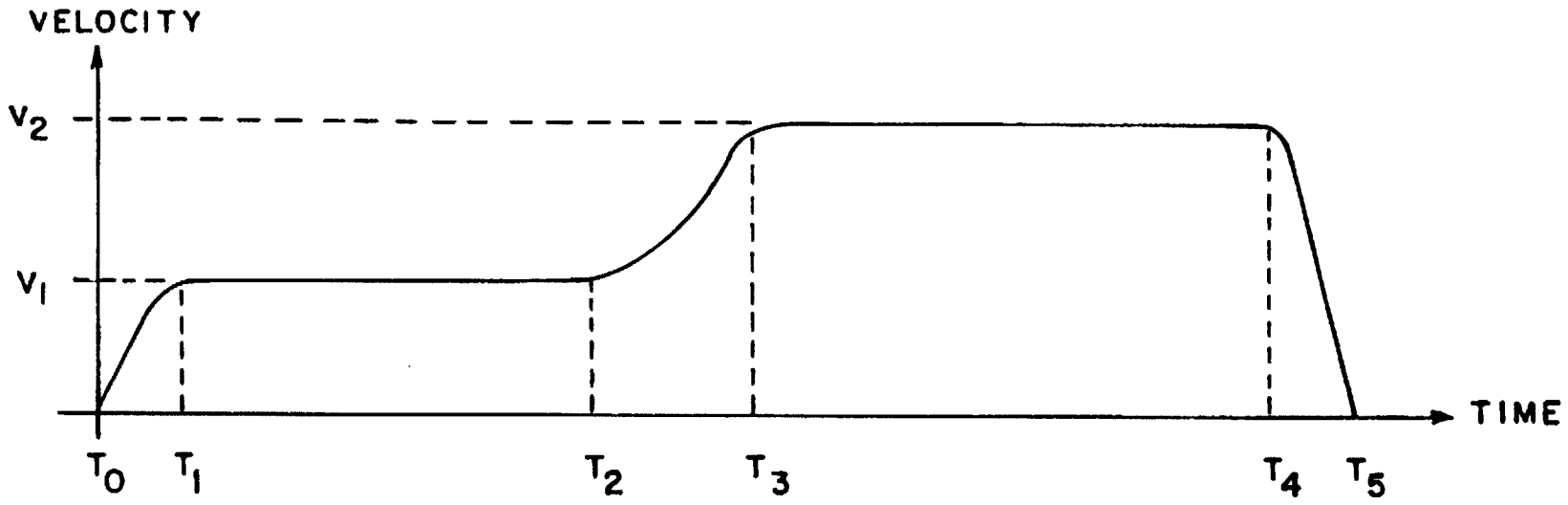
FIG. 8 is timing diagram showing the velocity of the print drum during the print cycle.

Referring to FIG. 8, a timing diagram of a preferred velocity profile of the print drum during the print cycle is shown. It is important to note that this velocity profile is suitable for use with either the first embodiment or the second embodiment of the present invention. Referring to FIGS. 4, 5 and 8, the print cycle occurs of a time interval between reference points $T_0$ and $T_5$. At the beginning of the print cycle, the print drum 111 accelerates until it reaches a first velocity $V_1$ at point $T_1$. The print drum 111 is held at velocity $V_1$ until point $T_2$. During the interval from point $T_1$ to $T_2$, the print head 134 produces the variable portion 54 of the postage indicia 50 on the second print surface 118 of the print drum 111. After the print head 134 finishes printing, the print drum 111 accelerates until it reaches a second velocity $V_2$ at point $T_3$. The second velocity $V_2$ is selected so as to match the linear speed of the envelope 20 as it is fed underneath the print drum 111 by the mailing machine. After the inks from the first print surface 116 and the second print surface 118 have been transferred to the envelope 20, the print drum 111 begins to decelerate at point $T_4$ until it returns to the home position at point $T_5$.

It will be appreciated by those skilled in the art that the first velocity $V_1$ and the second velocity $V_2$ are selected so as to produce quality printed postage indicia 50 at a high rate of throughput. Thus, the first velocity $V_1$, which is dependent upon a variety of factors, such as: imaging speed, nozzle density and desired dot resolution, is selected so as to allow the print head 134 to produce a quality image on the second print surface 118 of the print drum 111. Generally, the second velocity $V_2$ is selected so as to increase throughput of the overall system.

It will be apparent to those skilled in the art that numerous other suitable velocity profiles could be derived depending upon the desired performance characteristics of the overall mailing machine. For example, if necessary, between points $T_2$ and $T_3$ the print drum 111 could be accelerated to a velocity greater than $V_2$ and then decelerated just prior to contact with the envelope 20 so as to match the speed of the envelope 20. In this manner, any time lost during the interval between points $T_1$ and $T_2$ can be made up.

Moreover, additional advantages than those described above and various other modifications will readily occur to those skilled in the art. For example, those skilled in the art will recognize that the present invention is suitable for printing an entire image. Thus, the present invention should not be construed as restricted to employing dual printing technologies. Therefore, the inventive concept in its broader aspects is not limited to the specific details of the preferred embodiment but is defined by the appended claims and their equivalents.

What is claimed is:

1. A postage printer including a print drum for printing a postage indicia having a fixed portion and a variable portion, the print drum including a first print surface and a second print surface, the postage printer comprising:

an ink jet print head for printing the variable portion of the postage indicia on the second print surface;

a print head cap;

means for bringing the ink jet print head and the print head cap into a capped relationship and a spaced apart relationship;

wherein the ink jet print head prints while the ink jet print head and the print head cap are in the spaced apart relationship and the print drum passes between the print head and the print head cap.

2. The postage printer of claim 1, wherein:

the print drum has a substantially hollow interior; and in the spaced apart relationship the print head cap is located within the interior of the print drum.

3. The postage printer of claim 2, wherein:

the print drum completes one revolution during a print cycle;

the print drum returns to a home position after the print cycle;

the print drum includes a peripheral surface which includes the first print surface and the second print surface, the peripheral surface having an aperture; and when the print drum is in the home position, the print head and the print head cap are in the capped relationship and extend through the aperture of the print drum.

4. The postage printer of claim 3, further comprising:

means for mounting the print head in a stationary position; and means for repositioning the print head cap between the capped relationship and the spaced apart relationship.

5. The postage printer of claim 4, further comprising:

drive means for rotating the print drum: and wherein:

the print drum rotates at a first velocity while the ink jet print head prints the variable portion of the postage indicia on the second print surface; and the print drum rotates at a second velocity while the variable portion of the postage indicia on the second print surface is transferred to an envelope.

6. The postage printer of claim 5, wherein:

the second velocity is greater than the first velocity.

7. The postage printer of claim 1, further comprising:

drive means for rotating the print drum: and wherein:

the print drum rotates at a first velocity while the ink jet print head prints the variable portion of the postage indicia on the second print surface; and the print drum rotates at a second velocity while the variable portion of the postage indicia on the second print surface is transferred to an envelope.

8. The postage printer of claim 7, wherein:

the second velocity is greater than the first velocity.

9. A method of printing a postage indicia having a fixed portion and a variable portion, the method comprising the steps of:

(a) rotating a print drum through a print cycle;

(b) bringing an ink jet print head and a print head cap into a capped relationship and a spaced apart relationship; and (c) while the ink jet print head and the print head cap are in the spaced apart relationship and the print drum passes between the print head and the print head cap, printing the variable portion of the postage indicia on a print surface of the print drum using the ink jet print head.

10. The method of claim 9, further comprising the step(s) of:

(d) during the print cycle while the print head and the print head cap are in the spaced apart relationship, maintaining the print head cap in a substantially hollow interior of the print drum.

11. The method of claim 10, further comprising the step(s) of:

(e) providing the print drum with a peripheral surface having an aperture therethrough;

(f) rotating the print drum through one revolution during the print cycle; and (g) returning the print drum to a home position after the print cycle, wherein the print head and the print head cap are in the capped relationship and extend through the aperture of the print drum in the home position.

12. The method of claim 11, further comprising the step(s) of:

(h) rotating the print drum at a first velocity while the ink jet print head prints an image on the print drum; and (i) rotating the print drum at a second velocity while the image is transferred to an envelope.

13. The method of claim 12, wherein:

the second velocity is greater than the first velocity.

14. The method of claim 9, further comprising the step(s) of:

(h) rotating the print drum at a first velocity while the ink jet print head prints an image on the print drum; and (i) rotating the print drum at a second velocity while the image is transferred to an envelope.

15. The method of claim 14, wherein:

the second velocity is greater than the first velocity.

* * * * *